US006627802B1

(12) United States Patent
Jones

(10) Patent No.: US 6,627,802 B1
(45) Date of Patent: Sep. 30, 2003

(54) REINFORCING BRACES FOR STRINGED MUSICAL INSTRUMENTS AND METHOD FOR POSITIONING SAME

(76) Inventor: Grady Jones, 6250 Woodmoor Dr., Burton, MI (US) 48509

( * ) Notice: Subject to any disclaimer, the term of this patent is extended or adjusted under 35 U.S.C. 154(b) by 0 days.

(21) Appl. No.: 10/074,906

(22) Filed: Feb. 13, 2002

(51) Int. Cl.[7] ..... G10D 3/02
(52) U.S. Cl. ..... 84/290; 84/192
(58) Field of Search ..... 84/291, 290, 192, 84/294

(56) References Cited

U.S. PATENT DOCUMENTS 627,067 A 6/1899 Simpson
634,103 A 10/1899 Brandt
5,381,714 A * 1/1995 Kasha ..... 84/276
5,396,822 A 3/1995 Itokawa
5,952,592 A 9/1999 Teel
6,166,308 A 12/2000 Lam

* cited by examiner

*Primary Examiner*—Kimberly Lockett
(74) *Attorney, Agent, or Firm*—Young & Basile, P.C.

(57) ABSTRACT

The invention is a reinforcing system with vibrating plates of stringed musical instruments, as well as a method for determining the optimal placement of reinforcing braces on those plates. To determine the optimal size, shape and location of plate reinforcements, the plate is caused to vibrate at a known frequency, and the nodal and anti-nodal areas of the plate are mapped. Bracing of a size and shape corresponding to the mapped nodal areas are affixed to the plate, and the acoustic properties of the plate are then measured. Thereafter, the braces may be repositioned to optimize the tonal qualities of the instrument based on both objective and subjective criteria.

7 Claims, 3 Drawing Sheets

FIG - 2
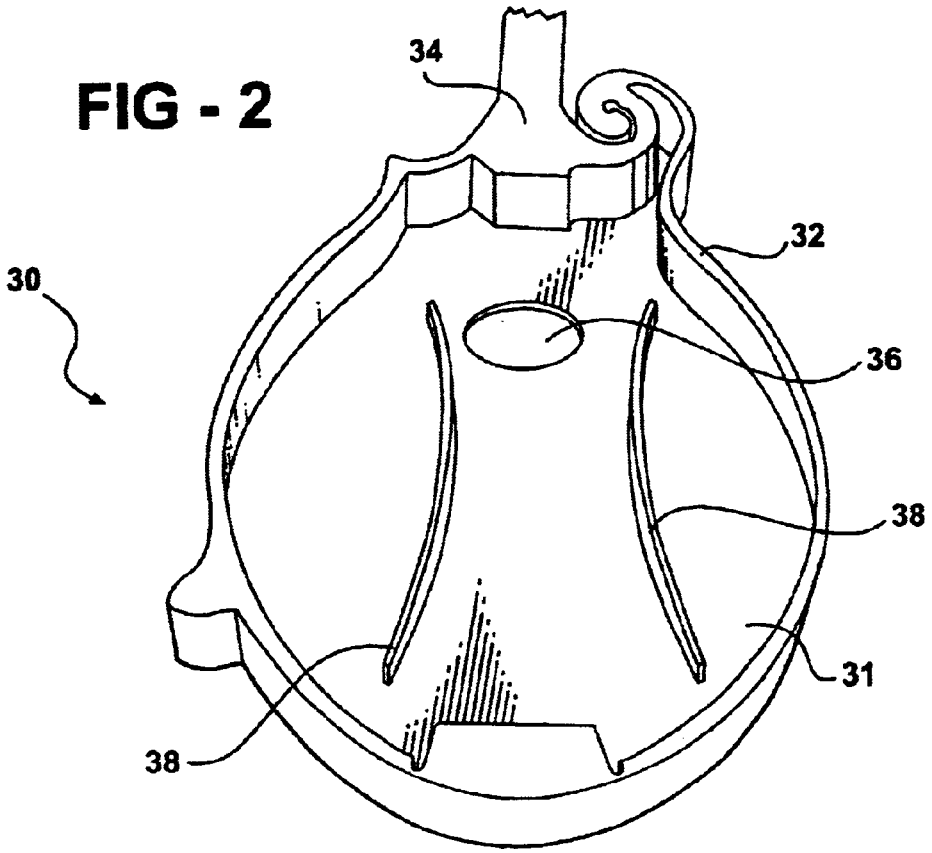
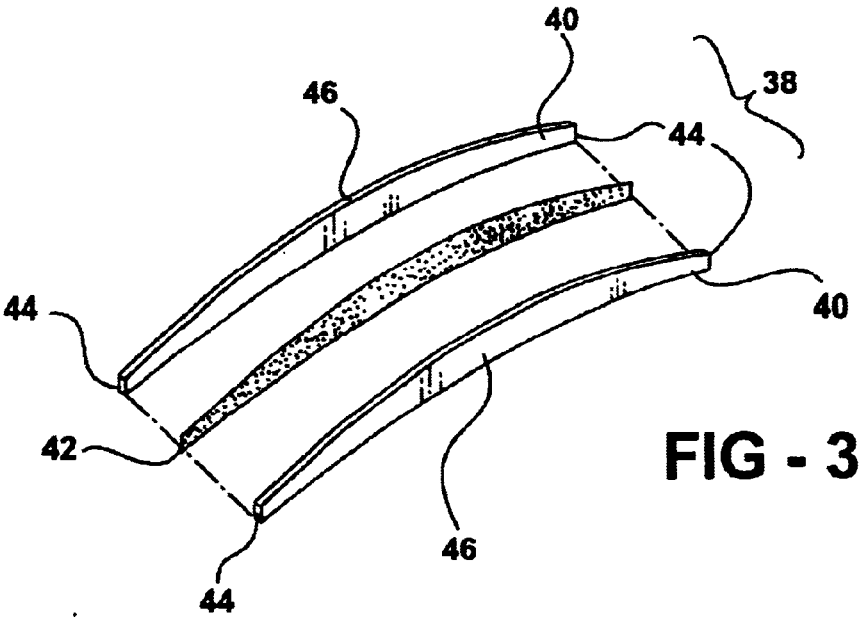
FIG - 3

REINFORCING BRACES FOR STRINGED MUSICAL INSTRUMENTS AND METHOD FOR POSITIONING SAME

FIELD OF THE INVENTION

The invention pertains to reinforcing braces for stringed musical instruments, and more particularly, the shaping and positioning of said braces in relation to the nodes of the vibrating plates of such instruments.

BACKGROUND OF THE INVENTION

Many stringed musical instruments, such as mandolins, violins and guitars are constructed in the form of a hollow box which forms the body of the instrument. This box, which typically consists of a top plate, a back plate and one or more side plates, serves, together with other elements, to support the strings so that they can vibrate properly, and to amplify the sound from the vibrating strings. It is known that the quality of sound radiated by such an instrument depends, in large part, on the structure of the body of the instrument, the nature of the material used for the body, and even the finish applied to the body.

Musical instrument design has been the work of artisans and craftsmen for years, and the production of a quality musical instrument producing a pleasing sound remains a function of both physical design and the experience and skill of the craftsmen. Nevertheless, in recent years, a greater understanding of the various properties of design and materials has been achieved. Numerous experimental scientific studies have been performed in an effort to determine the nature of the variables which, when combined, produce a stringed instrument having the most pleasing sound. An example of this type of study can be found in the article "The Acoustics of Violin Plates", *Scientific American*, October, 1981. There, the author summarizes techniques for testing the vibrational properties of the plates of stringed musical instruments. One of the techniques therein described involves the sprinkling of the plate with a fine powder, and thereafter causing the plate to vibrate. At certain frequencies known as eigen frequencies, this vibration bounces the powder into patterns which define the nodal and anti-nodal configurations of the plate at specific resonants frequencies. This work, first pursued in the late 1960's by Carl A. Stetson has served to define a number of "modes" or vibrational patterns corresponding to particular frequencies. According to Hutchins, the author of the above-referenced *Scientific American* article, the modes most important in tuning violin plates are modes 1, 2 and 5. Mode 2, for example, defines a generally "X" shaped pattern on the plate, whereas mode 5 defines a pair of somewhat semi-elliptical patterns disposed at opposite ends of the plate, each having a distinctive "C" shaped configuration.

The various designs of box body stringed instruments which have evolved are also known to present improved acoustical qualities based on the overall thickness of the top, back and side plates. Thicker plates, as a general rule, have less desirable acoustical properties, since greater string energy is required to make a heavier plate vibrate. Thinner plates, on the other hand, while being more acoustically desirable, provide insufficient structural support for the bridge, neck and tail piece. A balance must be achieved, therefore, between the structural integrity of the instrument and its sound qualities. The need for structural reinforcement of stringed instruments is well known, and the number of techniques have been disclosed for providing bracing to certain types of these instruments, for example, as disclosed by Lam in U.S. Pat. No. 6,166,308 and Teel in U.S. Pat. No. 5,952,592. The bracing disclosed in the afore described references, however, essentially disregards the acoustical effects of the application of such bracing. Limited appreciation of the acoustical effects of the application of bracing is disclosed by Itokawa in U.S. Pat. No. 5,396,822, which teaches the application of stiffeners along nodal lines adjacent to the base bar and sound post of a stringed instrument.

My research has taught that this simplified approach to bracing is inadequate, and that utilization of nodal analysis, like that performed by Stetson, provides a remarkably better basis for determining the shape and location of plate stiffeners in stringed instruments. Further, my work has provided valuable insights into the configuration, construction and location of stiffeners placed according to nodal analysis which optimize the acoustical qualities of stringed instruments.

SUMMARY OF THE INVENTION

My invention is an improved stringed musical instrument and a method for construction thereof. A stringed instrument of improved acoustical properties can be constructed by first analyzing the nodal and anti-nodal areas of the plates of the instrument utilizing induced vibration. The nodal and anti-nodal areas can be identified using a variety of means. One simple approach is to sprinkle the vibrating plate with granular particles. The vibrations of the plate results in migration of the particles toward non-vibrating areas and away from vibrating areas, facilitating identification of the nodal and anti-nodal areas. Another technique is the utilization of laser interferometry. Variation of the induced frequency results in the optical location of nodal and anti-nodal areas comprising separate modes of vibration dependent upon the frequency of vibration. Once these nodal and anti-nodal areas have been identified, structural bracing can be shaped and applied to the plate, in such a manner as to take full advantage of the natural vibration characteristics of the plate while still exhibiting the necessary strength to provide the structural support required by the instrument.

In one embodiment, improved acoustic qualities are obtained by using Stetson mode 5 nodal and anti-nodal areas, and the application to the anti-nodal areas of stiffeners formed of a laminate of wood and carbon fiber composite glued to the plate. Instruments constructed according to this method have demonstrated improved acoustic qualities together with improved structural strength.

DETAILED DESCRIPTION OF THE DRAWINGS

FIG. 2 is a perspective view of the interior of a stringed instrument showing the placement of structural braces; and FIG. 3 is a perspective and exploded view of the braces.

Figure 1A:
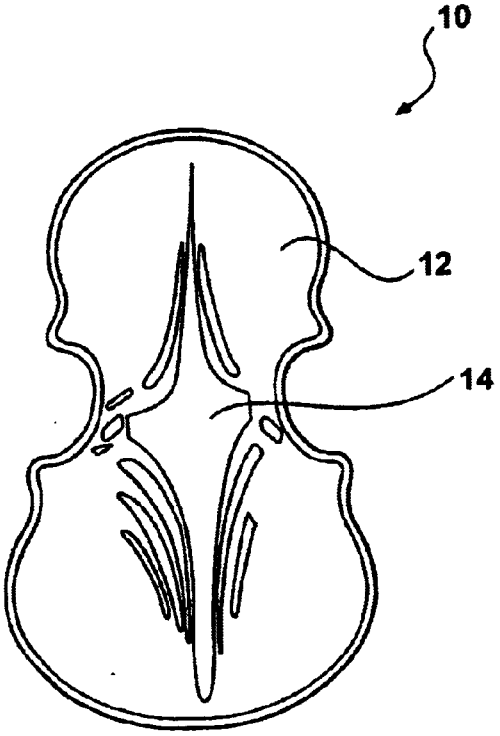
FIGS. 1A–1D are stylized views of a plurality of stringed instruments showing nodal and anti-nodal areas of the interior side of the top plate of a plurality of stringed instruments being vibrated under four different frequencies, with the nodal and anti-nodal areas mapped by the migration of granular particles.
Figure 1B:
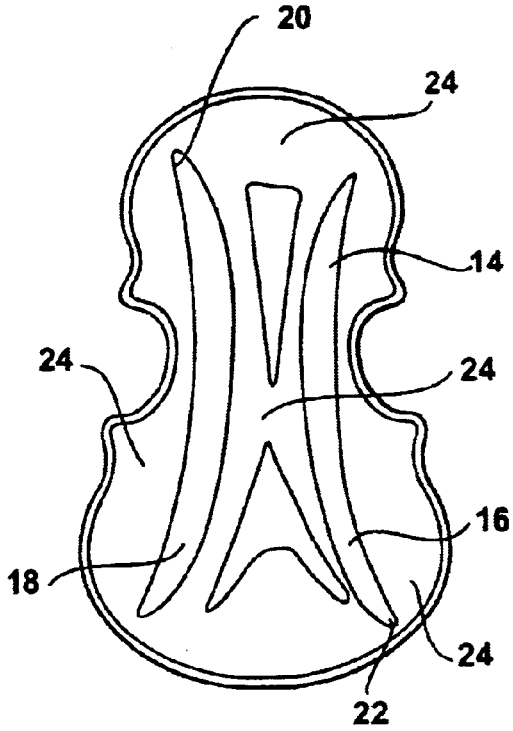
Figure 1C:
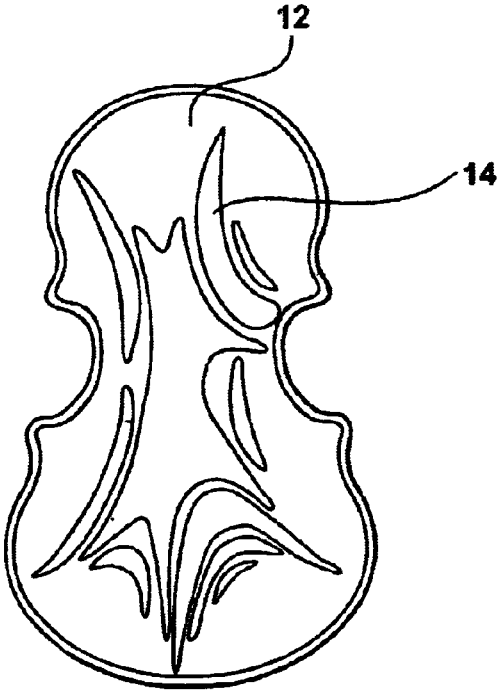
Figure 1D:
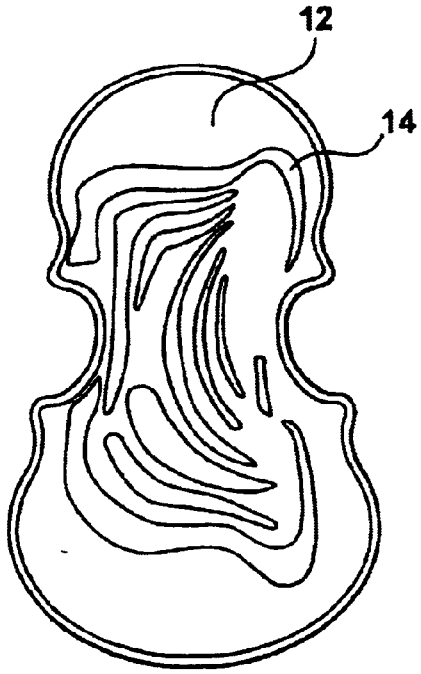
Figure 4A:
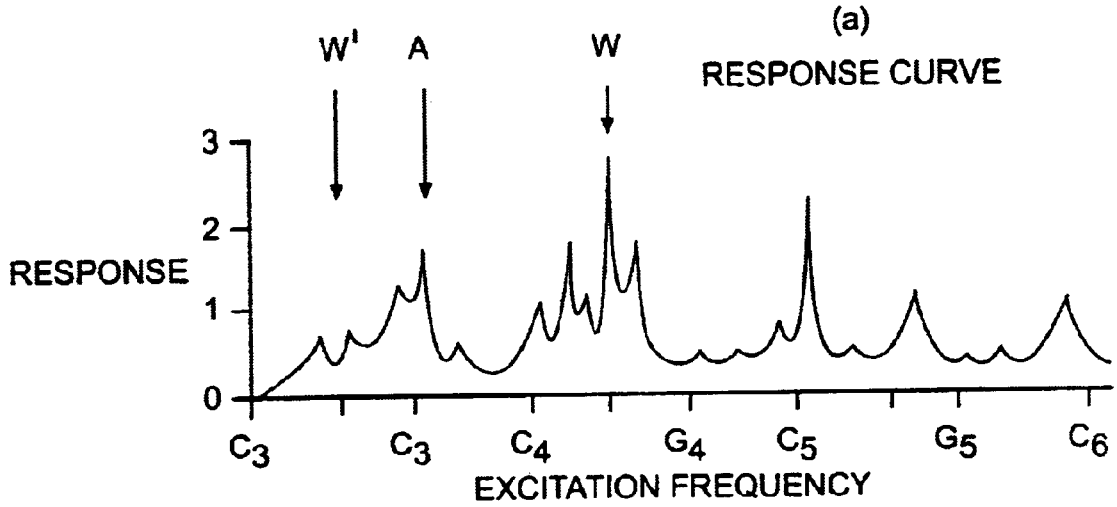
Figure 4B:
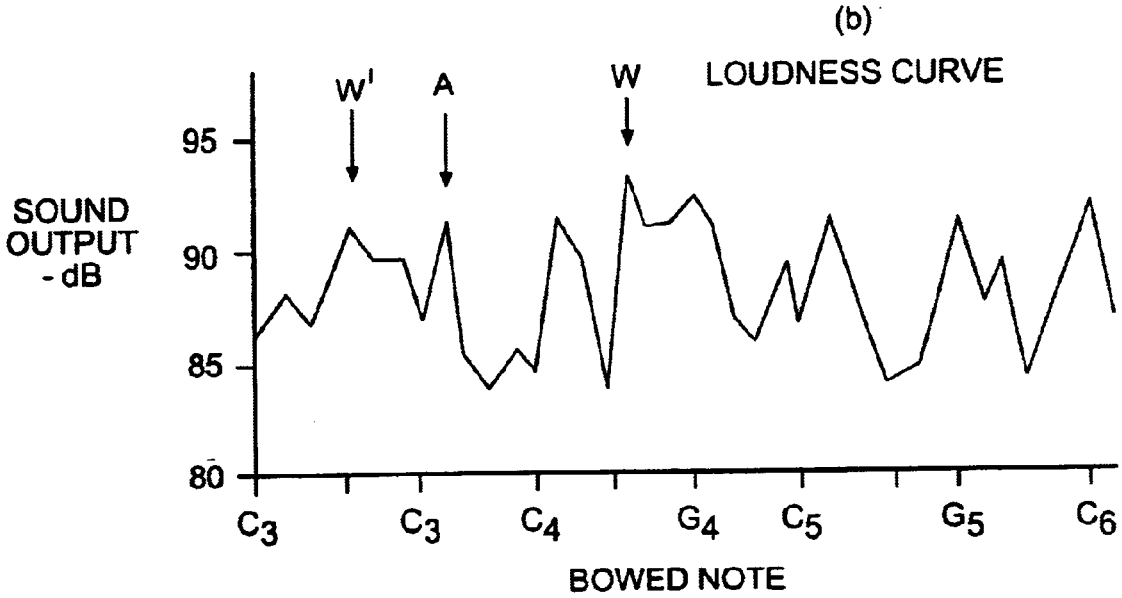

FIGS. 4*a* and 4*b* are typical response and loudness curves for a typical instrument.

DETAILED DESCRIPTION OF THE INVENTION

My invention can be understood by reference first to FIGS. 1A through 1D, which shows a plurality of views of a stringed musical instrument 10, and in particular, shows the top plate 12 and interior of an instrument, viewed with the back plate and side plates removed. In FIGS. 1A through 1D, a plurality of vibration modes is depicted, with the resultant distribution of granular particles 14 sprinkled on the plate into nodal and anti-nodal areas. Each figure shows the distribution of particulate matter when the plate is vibrated at a predetermined frequency. In the figure shown, the instrument body is that of a violin. In the instrument body of this configuration, as can be seen from FIG. 1B, the nodal pattern created is a pair of approximately symmetric open "C" shaped areas 16, 18 wherein the upper end 20 of the "C" is oriented proximate the proximal end of the neck of the instrument, and the lower end 22 of the "C" is located proximal the tail piece end of the instrument. The positions of the largest concentration of the particles 14 corresponds with the areas of lowest vibration of the plate, indicating optimal locations for structural bracing. Structural bracing so applied will provide the necessary physical support for the top plate against the various forces imposed upon it by the strings, while providing minimal interference with the vibration of the anti-nodal areas 24 designated in FIG. 1. The above-described methodology utilizing particulate matter as the marker elements for nodal and anti-nodal areas is but one method of locating the nodal patterns. Another well known technique is the use of hologram interferometry. In this technique, laser interferograms are made of the plate as it resonates at various frequencies. The interferograms are visible representations of the nodal patterns.

FIG. 2 shows the interior surface of the top plate 31 of a typical stringed musical instrument 30, in this case a mandolin, showing placement of a pair of braces constructed according to my invention on the inner surface of the top plate. The neck 34, sides 32 and sound hole 36 are depicted; the bottom plate is removed and not shown. Typically, such braces 38 are affixed to the instrument plates by adhesives, method of applications of which is well known. While it is possible to predetermine an approximately optimal location of the braces 38 which can be applied to the mass production of instruments utilizing these techniques, a substantially improved sound can be obtained from even mass produced stringed instruments utilizing easily performed customization techniques. First, it will be appreciated that while the optimal positioning of the bracing may produce the best natural vibration of the plates, it is also true that the area of best natural vibration of the plate may not coincide, precisely, with the position of the brace required to obtain the most pleasing sound. Accordingly, once the optimal position of braces have been determined to produce the optimal natural vibration of the plate, it is often desirable to reposition the braces slightly to obtain a more pleasing sound, based on the subjective determination of the individual constructing the instrument, or based on more objective testing, or both.

It has also been observed that the position of the nodal and anti-nodal areas migrates slightly once the braces are fixed to the plate. As a general rule, the nodal area tends to migrate toward the brace, within limits. Accordingly, repositioning, within limits, of the brace, without altering its shape, does not significantly effect the tonal efficiency or structural efficiency of the completed instrument. In one embodiment of my invention, the methodology involves testing the top plate for this pattern of vibration and repositioning the braces to optimize the tonal qualities of the instrument.

Although a determination of the optimal position and shape of the braces 38 can be determined, in large part, by mapping of the nodal patterns, it is also desirable to evaluate the performance of the position and shape of the brace by both subjective and objective sound measuring methodologies. The subjective evaluation can be nothing more than listening to the sound produced by the instrument, utilizing the skills of the trained ear of the craftsman or musician. A more objective approach involves the creation of both response and loudness curves, as shown in FIG. 4. FIG. 4A is a typical response curve for a typical stringed instrument, and FIG. 4B is a typical loudness curve for the same instruments. One method of testing the efficacy of placement and shape of braces as above-described involves the temporary affectation, using suitable reusable adhesive materials, of a brace of the composition herein described and of a shape corresponding to the nodal lines. After preparing braces of shape and size corresponding to the nodal lines, said braces can be temporarily fixed to the plate utilizing a dissolvable adhesive material. The plate so constructed may then be subjected to vibration over a wide frequency range, and the response of the plate to such frequencies can be charted as shown in FIG. 4A and a corresponding loudness curve likewise created according to FIG. 4B. This process can be repeated with successive temporary relocations of the braces until the optimum tonal quality is achieved, measured either subjectively or objectively as above described. Once the optimal response has been determined, the braces are permanently affixed to the desired location on the plate.

In one embodiment of the invention, the curve of the braces 38 along the long axis that corresponds to the shape of the nodal line of the plate 31 are formed by applying adhesive to the composite material and wood strips and clamping them into a mold or form with the appropriate shape until the adhesive sets. The laminated brace thus formed has the shape of the nodal lines, and has a strength to weight ratio much higher than wood. Further, the profile of each brace 38 is configured according to the orientation of the brace 38 on the plate 31. The brace 38 is made wide enough to provide sufficient bonding area to affix the brace 38 to the plate 31 and to prevent buckling or bending along the long axis. The height of the brace 38 is proportional to and varies with the bending moment of the forces applied to the top of the instrument by the stings. A brace 38 with this profile will represent the smallest and lightest brace 38 possible that will resist the forces applied by the strings. And, as can be seen in FIG. 2, braces 38 providing the necessary support are preferably affixed to the plate in pairs, corresponding to the pairs of anti-nodal areas identified in the typical mode 5 Stetson pattern.

I claim:

1. A method of reinforcing a plate of a stringed musical instrument comprising the steps of:

inducing a vibration in said plate;

observing said plate during said step of inducing said vibration to determine the areas of said plate having the maximum and minimum of vibration;

fabricating at least one reinforcing brace corresponding in shape and size to at least a portion of said area having said minimum vibration and attaching said at least one reinforcing brace to said plate in a position corresponding to said at least one portion of said area having said minimum vibration.

2. A method of reinforcing a plate of a stringed musical instrument comprising the steps of:

inducing a vibration in said plate;

dispersing a loose granular material on the surface of said plate during said step of inducing said vibration, whereby said granular material responds to said vibration by migration to areas of said plate having minimum vibration;

observing the plate during said step of inducing said vibration to determine the areas of said plate having maximum and minimum vibration;

fabricating at least one reinforcing brace corresponding in shape and size to at least a portion of said area having said minimum vibration and attaching said at least one reinforcing brace to said plate in a position corresponding to said at least one portion of said area having said minimum vibration.

3. A stringed musical instrument comprising at least one plate, said at least one plate characterized by areas of maximum vibration and minimum vibration in response to induced vibration in said at least one plate, and at least one reinforcing brace positioned on said at least one plate at a position corresponding to said area of minimum vibration.

4. The apparatus of claim 3, wherein said at least one reinforcing brace comprises a laminate of wood and carbon fiber.

5. The method of claim 1, wherein said at least one reinforcing brace comprises a laminate of wood and carbon fiber.

6. The method of claim 2, wherein said at least one reinforcing brace comprises a laminate of wood and carbon fiber.

7. The apparatus of claim 3, wherein said reinforcing brace further comprises a brace of a shape and dimension which corresponds to said at least one area of minimum vibration.

* * * * *